US009281615B1

(12) United States Patent
Plaza et al.

(10) Patent No.: US 9,281,615 B1
(45) Date of Patent: Mar. 8, 2016

(54) RETAINER CLIP FOR A WIRE HARNESS

(71) Applicants: Aaron M. Plaza, Canterbury, NH (US); Mark Seymour, Hillsboro, NY (US)

(72) Inventors: Aaron M. Plaza, Canterbury, NH (US); Mark Seymour, Hillsboro, NY (US)

(73) Assignee: OSRAM SLYVANIA Inc.

( * ) Notice: Subject to any disclaimer, the term of this patent is extended or adjusted under 35 U.S.C. 154(b) by 0 days.

(21) Appl. No.: 14/689,720

(22) Filed: Apr. 17, 2015

(51) Int. Cl.
*H01R 13/625* (2006.01)
*H01R 13/627* (2006.01)

(52) U.S. Cl.
CPC ..... *H01R 13/6275* (2013.01); *H01R 2201/26* (2013.01)

(58) Field of Classification Search
CPC . H01R 13/62; H01R 13/6275; H01R 2201/26
USPC ..... 439/350, 357, 358
See application file for complete search history.

(56) References Cited

U.S. PATENT DOCUMENTS

| | | | | |
|---|---|---|---|---|
| 9,136,646 | B2 * | 9/2015 | Naito | H01R 27/00 |
| 9,147,972 | B2 * | 9/2015 | Ohmura | H01R 13/641 |
| 9,184,532 | B2 * | 11/2015 | Crovetti | H01R 13/5213 |
| 2015/0062952 | A1 | 3/2015 | Lessard et al. | |

FOREIGN PATENT DOCUMENTS

| | | |
|---|---|---|
| WO | 2014094706 | 6/2014 |

OTHER PUBLICATIONS

Co-filed U.S. Appl. No. 14/689,780 filed Apr. 17, 2015 on behalf of Osram Sylvania Inc.
Product data sheet of ERNI MiniBridge—Koshiri Single Row connector, Catalog E 074650, available at www.erni.com dated Aug. 2014 (4 pages, color).

* cited by examiner

*Primary Examiner* — Khiem Nguyen
(74) *Attorney, Agent, or Firm* — Edward S. Podszus

(57) ABSTRACT

Retainer clip (100) attachable to motor vehicle headlamp (10) for inhibiting second electrical connector (72) of wiring harness (44) from unintentionally separating from mating first connector (52) on the PCB (60) of the lamp. Retainer clip comprises a deformable retaining arm (110) configured to inhibit separation of the first connector (52) and a second connector (72) upon assembly thereof with the first connector (52) and the second connector (72); a second connector receptacle (140) defined by retainer clip body (102), the second connector receptacle (140) configured to receive the second connector (72) therein; and a support base (160) configured to cooperate with the motor vehicle lamp (10) to align the second connector (72) with the first connector (52) in a connection plane (82) to assemble the second connector (72) and the first connector (52).

17 Claims, 5 Drawing Sheets

FIG. 5
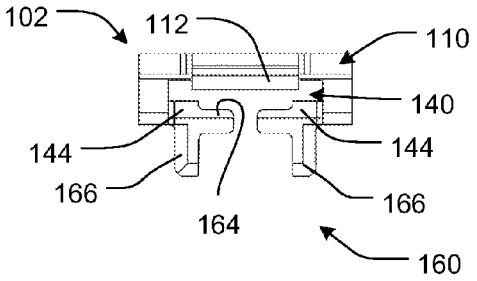
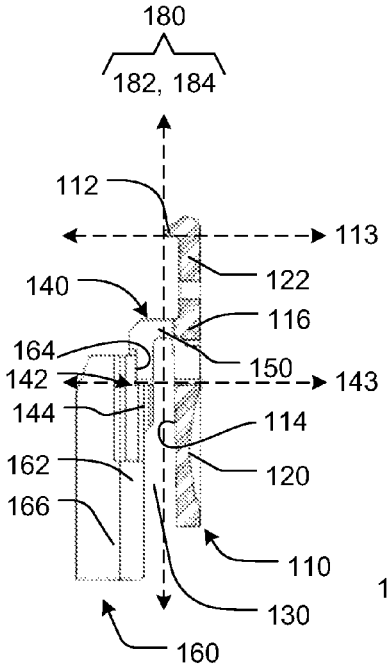
FIG. 7
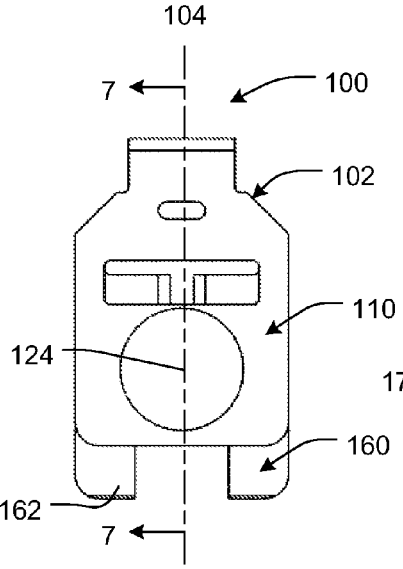
FIG. 3
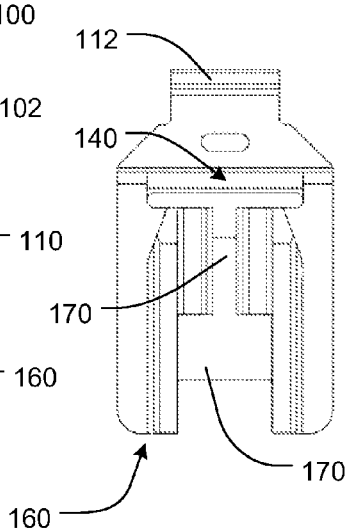
FIG. 4
FIG. 6
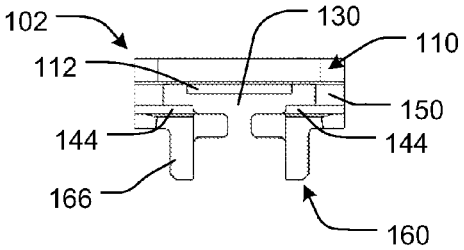

RETAINER CLIP FOR A WIRE HARNESS

CROSS REFERENCE TO RELATED APPLICATIONS

N/A

TECHNICAL FIELD

The present disclosure relates to a clip attachable to a lamp for inhibiting an electrical connector of a wire harness from unintentionally separating from a mating connector on the lamp. More particularly, it relates to an injection molded thermoplastic clip to augment retention force provided by a conventional locking latch on the wire harness connector that is attached to a printed circuit board (PCB) header attached to the printed circuit board.

BACKGROUND

Conventional electrical connectors such as sold by the company ERNI Electronics known in the trade as mini-bridge connectors, some of which are known as Koshiri-type mini-bridge connectors, have a header attached to a PCB and a connector attached to a wire harness that matingly engage via a selectively releasable plastic latch, shown in PCT WO 2014/094706 (Lappoehn) and herein as first and second connectors 52, 72 at e.g. FIGS. 8 and 12. Common mini-bridge connectors can provide approximately 20N of retention force resisting disconnection. Such a header connector is usefully attached to an automotive LED headlamp of the type shown in US Pat. Appln US2015/0062952 (Lessard; Plaza; Seymour), in particular with reference to FIGS. 9-10 therein, as attached to the PCB shown as reference numeral 46. Under some circumstances it is desirable to increase the retention force over that provided by such mating connectors themselves.

BRIEF DESCRIPTION OF THE DRAWINGS

Reference should be made to the following detailed description, read in conjunction with the following figures, wherein like numerals represent like parts:

FIG. 3 shows a top plan view of the retainer clip according to the present disclosure;

FIG. 4 shows a bottom plan view of the retainer clip according to the present disclosure;

FIG. 5 shows a front (leading) end view of the retainer clip according to the present disclosure;

FIG. 6 shows a rear (trailing) end view of the retainer clip according to the present disclosure;

FIG. 7 shows a side cross-sectional view of the retainer clip according to the present disclosure taken along line 7-7 of FIG. 3;

For a thorough understanding of the present disclosure, reference is made to the following detailed description, including the appended claims, in connection with the above-described drawings. Although the present disclosure is described in connection with exemplary embodiments, the disclosure is not intended to be limited to the specific forms set forth herein. It is understood that various omissions and substitutions of equivalents are contemplated as circumstances may suggest or render expedient. Also, it should be understood that the phraseology and terminology used herein is for the purpose of description and should not be regarded as limiting.

DETAILED DESCRIPTION INCLUDING BEST MODE OF A PREFERRED EMBODIMENT

Figure 12:
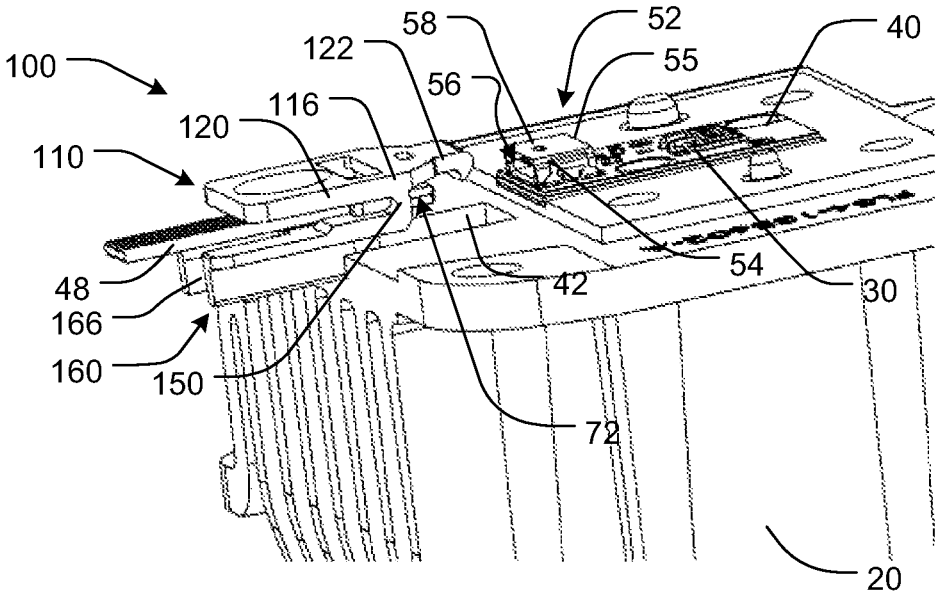
FIG. 12 shows the retainer clip of the present disclosure assembled with the wire harness, and the guide rails of the retainer clip located in a guide channel of the lamp to align the wire harness connector with the lamp connector in a connection plane to assemble the wire harness connector with the lamp connector.

By way of introduction, while briefly referring to FIG. 12, the present disclosure sets forth a retainer clip 100 to secure an electrical connection formed by a first connector 52 and a second connector 72, particularly where the first connector 52 and the second connector 72 form what may be referred to in the art as a "wire-to-printed-circuit-board" connection, or more simply a "wire-to-board" connection. As such, the retainer clip 100 may be used in a host of applications which make use of wire-to-board connections, which may include electronic devices, computer devices and motor vehicle devices to name a few.

Figure 1:
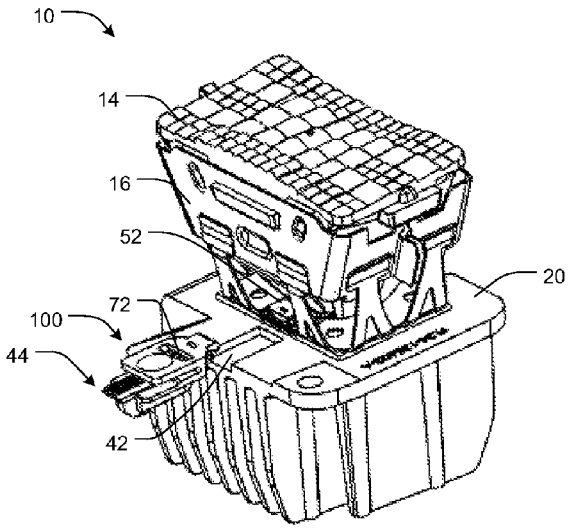
FIG. 1 shows a motor vehicle lamp with a retainer clip according to the present disclosure assembled with a wire harness prior to connecting the retainer clip and wire harness to the lamp.

Referring to FIG. 1, as set forth herein, retainer clip 100 may particularly secure an electrical connection formed by a first connector 52 of a motor vehicle lamp 10 and a second connector 72 of a wire harness 44 configured to mate with each other to establish the electrical connection. However, as set forth above, while retainer clip 100 is disclosed in such application, the application of the retainer clip 100 disclosed herein is merely an exemplary application in which the retainer clip 100 may be utilized.

Lamp 10 may comprise a lens 14 which is secured in a lens housing 16. The lens housing 16 may be secured to a mounting base 20, which may also function as a mounting bracket and/or heat sink. As shown, lamp 10 is a headlamp of a motor vehicle, particularly an automobile, however in other embodiments lamp 10 may be any other type of lamp of any type of motor vehicle.

Figure 2:
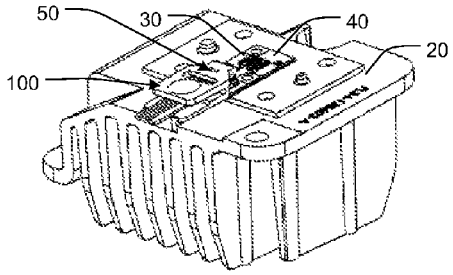
FIG. 2 shows the motor vehicle lamp of FIG. 1 with a lens and lens housing thereof removed, and the retainer clip and wire harness of FIG. 1 assembled to the lamp.

Referring to FIG. 2, there is shown lamp 10 with lens 14 and lens housing 16 removed to expose a lamp light source 30, which may comprise an LED light engine including one or mode LED modules and an LED driver, mounted to a printed circuit board (PCB) 40. The lamp light source 30 may receive power and operational signals through a connection apparatus 50, which may comprise retainer clip 100 in conjunction with the first connector 52 and the second connector 72.

Referring briefly to FIG. 12 once again, the first connector 52 may comprise a first connector housing 54, which may have a substantially rectangular shape. First connector housing 54 may include a plug receptacle 56, which may also have a substantially rectangular shape. Plug receptacle 56 may comprise a cavity which houses a plurality (row) of electrically conductive prongs (male terminal contacts).

As shown, the first connector 52 may be a printed circuit board (PCB) pin header (e.g. box header or shrouded header) mounted to printed circuit board (PCB) 40, and more particularly an angled header (i.e. the entrance to plug receptacle 54 may be perpendicular at a 90 degree right angle to the surface of the printed circuit board (PCB) 40). The first connector 50 may be secured to the printed circuit board (PCB) 40, which may be secured to the lamp 10 by being clamped between the lens housing 16 and the mounting base 20.

Figure 8:
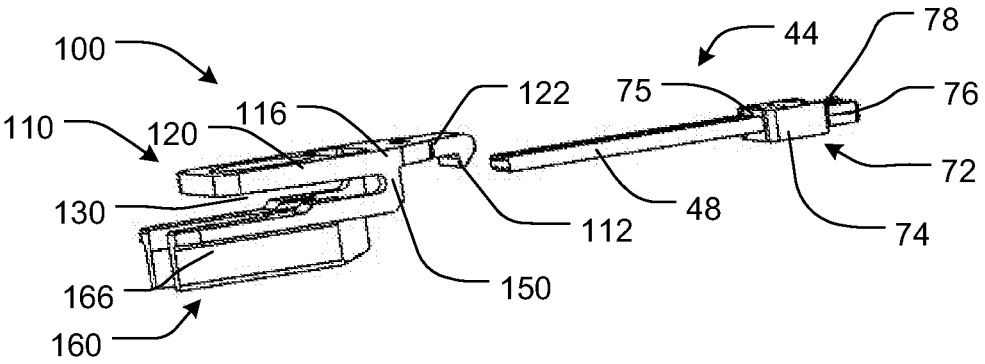
FIG. 8 shows a side perspective view of the retainer clip of the present disclosure prior to the retainer clip being assembled with the wire harness.
Figure 9:
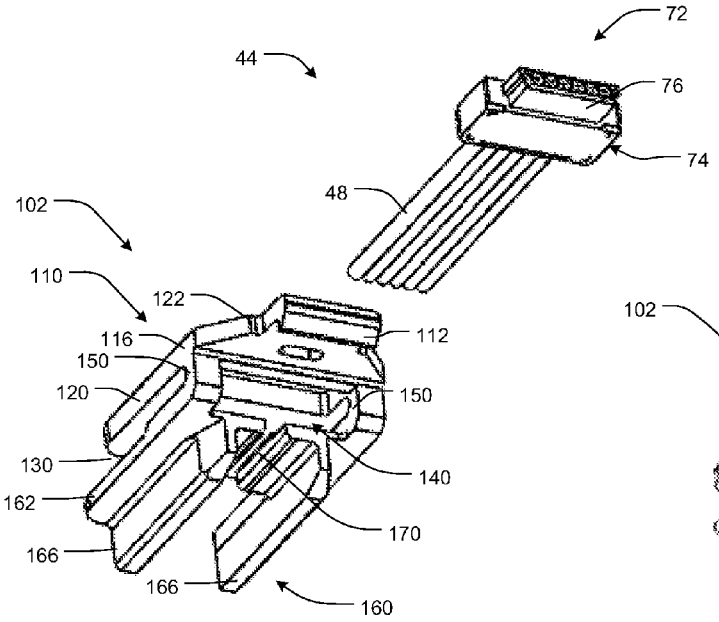
FIG. 9 shows a front perspective view of the retainer clip of the present disclosure prior to the retainer clip being assembled with the wire harness.
Figure 11:
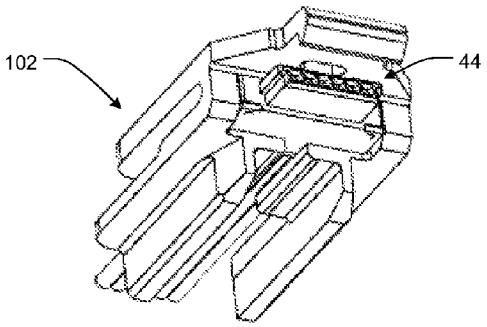
FIG. 11 shows a front perspective view of the retainer clip of the present disclosure after the retainer clip has been assembled with the wire harness.

As best shown in FIG. 8 and FIG. 9, second connector 72, which may be a male wire harness connector or, more particularly, a header connector where the first connector is a printed circuit board (PCB) header, may include a second connector housing 74 which may have a substantially rectangular shape. Second connector housing 74 may include a plug 76, which may also have a substantially rectangular shape, particularly to physically mate with plug receptacle 56 of first connector 52. Plug 76 may house a plurality of electrically conductive prong receptacles (female terminal contacts) which are configured to physically and electrically mate with electrically conductive prongs of the first connector 52.

As such, first connector 50 and second connector 70 may be adapted to physically (mechanically) and electrically couple and operationally mate with one another. As shown, first connector 52 and second connector 72 may form a wire-to-board connector assembly.

First connector 52 and second connector 72 may be retained together by a first positive mechanical engagement connection. As used herein, a positive mechanical engagement connection may be understood as a connection formed between the components which does not rely solely on friction to inhibit separation of the components, and which includes a mechanical interlock to inhibit separation of the components (e.g. overlapping surfaces).

In order to provide a positive mechanical engagement connection, the second connector 72 may include a deformable tab 78 (best shown in FIG. 8) which is configured to fit into and engage with window opening 58 (best shown in FIG. 12) of first connector 52 upon assembly of the first connector 52 and the second connector 72. Such may provide a first retention force level against separation of the first connector 52 and the second connector 72.

Alternatively, or in addition to the use of the positive mechanical engagement connection formed by deformable tab 78 and window opening 58, retainer clip 100 may be used to also provide a positive mechanical engagement connection which inhibits separation of the first connector 52 and the second connector 72. Where retainer clip 100 is used in combination with the positive mechanical engagement connection formed by deformable tab 78 and window opening 58, the retainer clip 100 may provide a retention force level greater than the retention force level provided by the deformable tab 78 and window opening 58. The structure of retainer clip 100 will now be discussed in detail, after which will be discussed the operation and assembly of retainer clip 100 with first connector 52 and second connector 72.

Referring now to FIGS. 3-7, there are shown several view of retainer clip 100. Retainer clip 100 may particularly comprise a monolithic retainer clip body 102, which may be particularly formed of an injection molded thermoplastic composition in a known manner. Exemplary thermoplastic compositions may include polyamide (a/k/a nylon), polyimide, polyacetal and polyolefin (e.g. polypropylene). In other embodiments, retainer clip body 102 may also essentially consist essentially of, or consist of, a thermoplastic composition.

As best shown by FIG. 7, retainer clip body 102 comprises a deformable retaining arm 110 and an underlying support base 160. Deformable retaining arm 110 is configured to inhibit separation of the first connector 52 and a second connector 72 upon assembly thereof with the first connector 52 and the second connector 72, while support base 160 is configured to cooperate with the motor vehicle lamp 10 to align the second connector 72 with the first connector 52 in an operation plane 180, which may be further understood as a connection plane 182 or separation plane 184, depending on whether the first connector 52 and second connector 72 are being assembled or disassembled, respectively. Thus, for the present embodiment, it should also be understood that connection plane 182 and separation plane 184 are the same plane. However, it may be plausible for such to be different planes in other embodiments.

Retainer clip body 102 also comprises a second connector receptacle 140 defined by the retainer clip body 102, which is configured to receive the second connector 72, and more particularly the second connector housing 74, therein. As shown, second connector receptacle 140 is located between the inner facing surfaces 114, 164 of the deformable retaining arm 110 and platform 162 of support base 160, respectively, which may be substantially parallel surfaces. As used herein, surfaces 114, 164 may be considered substantially parallel if the surfaces 114, 164 are within 10 degrees, and more particularly within 5 degrees, of being parallel.

Figure 10:
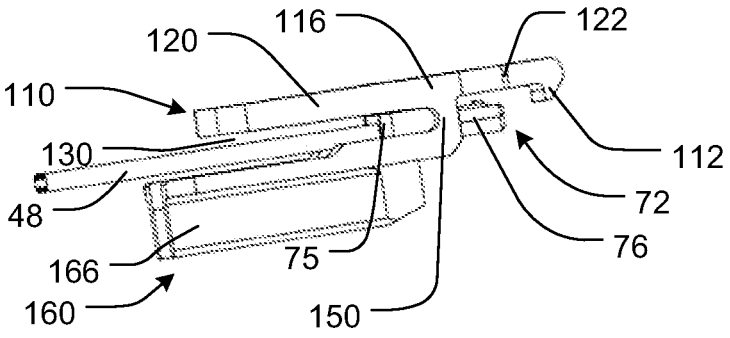
FIG. 10 shows a side perspective view of the retainer clip of the present disclosure after the retainer clip has been assembled with the wire harness.

Retainer clip body 102 also comprises a first engagement element 112 configured to engage with the first connector 52, and a second engagement element 142 configured to engage with the second connector 72, particularly to inhibit separation thereof in separation plane 184. As shown, the first engagement element 112 may be part of deformable retaining arm 110, while the second engagement element 142 may be part of support base 160. More particularly, the second engagement element 142 may be provided by wall 144 of the support base 160 (which is substantially transverse to platform 162 of support base 160) which provides an end wall stop for the second connector receptacle 140. As shown, the wall 144 of the support base 160 is positioned and arranged to engage proximal end 75 (see FIG. 10) of the second connector housing 74 of the second connector 75, which is also the end of the second connector housing 74 that the wires 48 enter/exit the second connector 72.

As will be made more apparent with discussion of the operation of the retainer clip 100 herein, the first connector 52 and the second connector 72 are separable in separation plane 184. In order to inhibit separation of the first connector 52 and the second connector 72, the first engagement element 112 is configured to detachably engage the first connector 52 in a first connector engagement plane 113 substantially transverse to the separation plane 184, and the second engagement element 142 is configured to detachably engage the second connector 72 in a second connector engagement plane 143 substantially transverse to the separation plane 184.

As used herein, the first connector engagement plane 113 may be considered substantially transverse to the separation plane 184 if the first connector engagement plane 113 is within 10 degrees, and more particularly within 5 degrees, of being perpendicular to the separation plane 184, and the second connector engagement plane 143 may be considered substantially transverse to the separation plane 184 if the second connector engagement plane 143 is within 10 degrees, and more particularly within 5 degrees, of being perpendicular to the separation plane 184.

The first engagement element 112 comprises a leading engagement element of the retainer clip body 102 configured to engage with a distal end 55 (see FIG. 8) of the first connector 52, and the second engagement element 142 comprises a trailing engagement element of the retainer clip body 102 configured to engage with a proximal end 75 (see FIG. 10) of the second connector 72. As used herein the first engagement element 112 may be considered a leading engagement element, particularly as the first engagement element 112 leads the second connector 72 into engagement with the first connector 52, while the second engagement element 142 may be considered a trailing engagement element, particularly as the second engagement element 142 trails the second connector 72.

As mentioned above, the first engagement element 112 is disposed on deformable retaining arm 110, and may particularly comprise a snap-fit hook. With regards to operation of deformable retaining arm 110, as explained in greater detail below, deformable retaining arm 110 is movable, and more particularly pivotable, to engage the first engagement element 112 with the first connector 52 and disengage the first engagement element 112 from the first connector 52.

As best shown by FIGS. 5-7, the deformable retaining arm 110 and the support base 160 may be joined in spaced relationship by at least two laterally spaced pivot regions 150 of the retainer clip body 102, which are arranged substantially transverse to a longitudinal length of the deformable retaining arm 110 along the longitudinal axis 104. As used herein, a pivot region 150 of the retainer clip body 102 may be considered substantially transverse to the longitudinal length of the deformable retaining arm 110 if the pivot region 150 is within 10 degrees, and more particularly within 5 degrees, of being perpendicular to the deformable retaining arm 110.

More particularly, the deformable retaining arm 110 may be joined with the support base 160 at a mid-region 116 of the deformable retaining arm 110 by the at least two laterally spaced pivot regions 150 of the retainer clip body 102. In such a manner, when a depression force is placed on a trailing portion 120 of the deformable retaining arm 110, a leading portion 122 of the deformable retaining arm 110 is configured to pivot about the laterally spaced pivot regions 150 and the first engagement element (112) disengage from the first connector 52. As shown, the trailing portion 120 may include a recess 124 to properly locate where the depression force should be applied.

It should be understood that while the foregoing description describes the deformable retaining arm 110 as pivotable in the foregoing manner, deformable retaining arm 110 may simply deform, and more particularly elastically deform, without necessarily pivoting to engage the first engagement element 112 with the first connector 52 as explained in greater detail below.

The second connector receptacle 140 may be located between and partially defined by the at least two laterally spaced pivot regions 150 of the retainer clip body 102. As such, it may be understood that the second connector receptacle 140 is defined on two opposing sides by deformable retaining arm 110 and the support base 160 of the retainer clip body 102, and the remaining opposing sides by the laterally spaced pivot regions 150 of the retainer clip body 102.

As shown, the trailing portion 120 of the deformable retaining arm 110 overlies the support base 160, and the at least two laterally spaced pivot regions 150 space the deformable retaining arm 110 and the support base 160 from each other such that a wire harness passage 130 is established between the deformable retaining arm 110 and the support base 160. Also as shown, the wire harness passage 130 extends completely through the retainer clip body 102, with the second connector receptacle 140 forming a portion of the wire harness passage 130 between the deformable retaining arm 110 and the support base 160. Among other benefits, the platform 162 may support the wires 48 of the wire harness 44 such that the wires 48 do not make contact with the mounting base 20, which may be used as a heat sink. Also as shown, the spatial distance between the inner facing surfaces 114, 164 of the deformable retaining arm 110 and the support base 160, respectively, is substantially equal to the width of the second connector receptacle 140.

In order to accommodate the wires 48 of the wire harness 44 to extend through the confines of the retainer clip body 102, particularly to extend through the wire harness passage 130 between the trailing portion 120 of the deformable retaining arm 110 and the platform 162 of support base 160, the wall 144 of the support base 160 is positioned and arranged to only engage proximal end 75 of the second connector housing 74 of the second connector 72, and not engage the wires 48 of the wire harness 44. In the foregoing manner, the wires 48 of the wire harness 44 are able to freely extend through wire harness passage 130, however, wall 144 of the support base 160 inhibits the second connector housing 74 from passing into the portion of wire harness passage 130 remote from the second connector receptacle 140.

As best shown by FIG. 4, retainer clip body 102 may further include at least one aperture 170, which extends along the full length of the platform 162 of the support base 160, and forms an elongated slot which intersects with wire harness passage 130. As such, the wire harness passage 130 may be open and not fully enclosed along its overall length, including the second connector receptacle 140. In such manner, as explained in greater detail below, aperture 170 facilitates inserting the wires 48 of the wire harness 44 into the wire harness passage 130 without having to disconnect the first connector 52 and the second connector 72 from one another. Alternatively, aperture 170 also facilitates removing the wires 48 of the wire harness 44 from the wire harness passage 130 without having to disconnect the first connector 52 and the second connector 72 from one another.

Thus, with the foregoing configuration of the retainer clip body 102, it may be understood that the retainer clip body 102 is configured such that, when the first connector 52 and the second connector 72 are connected, the retainer clip body 102 may be assembled with or disassembled from the first connector 52 and the second connector 72 without disconnecting the first connector 52 and the second connector 72 from each other. Furthermore, the retainer clip body 102 is configured such that the wires 48 of the wire harness 44 may be installed or removed from the wire harness passage 130 when the first connector 52 and the second connector 72 are connected without disconnecting the first connector 52 and the second connector 72 from each other.

As set forth herein, support base 160 is configured to cooperate with the motor vehicle lamp 10 to align the second connector 72 with the first connector 52 in an operation plane 180, which may be further understood as a connection plane 182 or separation plane 184, depending on whether the first connector 52 and second connector 72 are being assembled or disassembled, respectively.

As best shown in FIG. 12, the support base 160 may comprise at least one guide rail 166, and the motor vehicle lamp 10 may comprises at least one guide channel 42, which may be formed in the mounting base 20. With such structure, the support base 160 is configured to cooperate with the motor vehicle lamp 10 to align the second connector 72 with the first connector 52 in the connection plane 182 to assemble the second connector 72 and the first connector 52 by arranging, and more particularly seating, the at least one guide rail 166 of the support base 160 in the guide channel 42 of the motor vehicle lamp 10.

More particularly, the support base 160 may comprise at least two guide rails 166, and the support base 160 may be configured to cooperate with the motor vehicle lamp 10 to align the second connector 72 with the first connector 52 in the connection plane 182 to assemble the second connector 72 and the first connector 52 by arranging, and more particularly seating, the at least two guide rails 166 of the support base 160 in the guide channel 42 of the motor vehicle lamp 10.

Referring now to FIGS. 8-13, during use, retainer clip 100 may be assembled to and disassembled from the first connector 52 and the second connector 72 as will now be discussed.

As best shown in FIGS. 8-11, prior to the assembly of the first connector 52 and the second connector 72, the second connector 72 may be assembled with the retainer clip body 102. Such may be performed by first inserting the wires 48 of the wire harness 44 into the wire harness passage 130 between deformable retaining arm 110 and support base 160. Thereafter, the wire harness 44 and the second connector 72 may be manipulated relative to one another such that the second connector housing 74 enters the second connector receptacle 140 and is retained therein, particularly with the proximal end 75 of the second connector housing engaging the second engagement element 142 in abutting relationship. Such may be particularly seen in FIG. 10 and FIG. 11.

Figure 13:
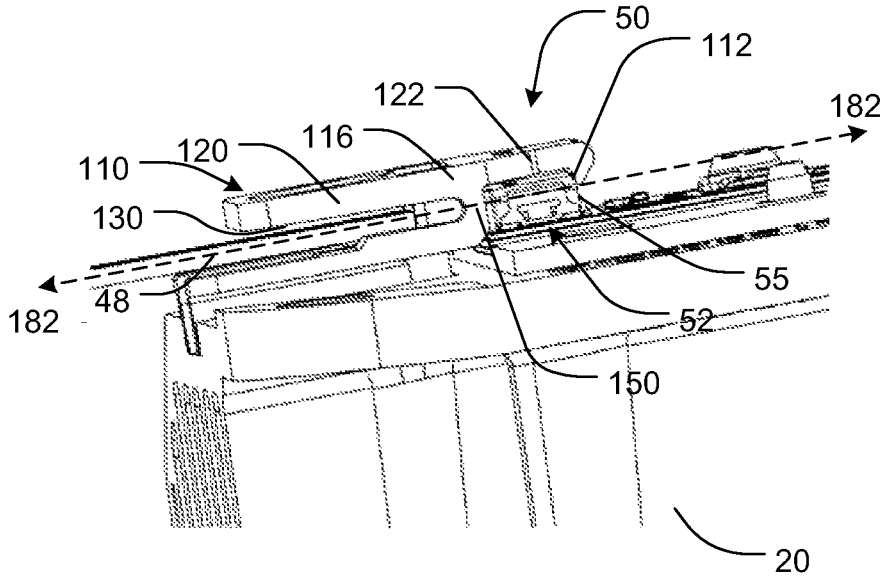
FIG. 13 shows the retainer clip, wire harness connector and lamp connector after assembly thereof.

Thereafter, as shown in FIG. 12 and FIG. 13, the guide rails 166 of the retainer clip body 102 may be inserted into guide channel 42 of mounting base 20 of motor vehicle lamp 10, such that the bottom of the guide rails 166 make contact with the bottom of the guide channel 42, in which case the first connector 52 and the second connector are now aligned in connection plane 182.

The second connector 72/retainer clip body 102 subassembly may then be slid in an engagement direction such that the first engagement element 112 makes contact with the first connector housing 54 of the first connector 52, causing the deformable retaining arm 110 to pivot about pivot regions 150 of the retainer clip body 102, resulting in the leading portion 122 of the deformable retaining arm 110 to pivot upwards and the first engagement element 112 to slide along the top of the first connector housing 54 while the trailing portion 120 of the deformable retaining arm 110 pivots downwards. Simultaneously, the plug 76 of the second connector 72 enters plug receptacle 56 of the first connector 52 to establish electrical contact of the terminal contacts therein. Thereafter, as the first engagement element 112 extends past the top of the first connector housing 54, the elastic memory in the pivot regions 150 of the retainer clip body 102 forces the deformable retaining arm 110 to pivot such that the leading portion 122 of the deformable retaining arm 110 pivots downwards and the first engagement element 112 engages with the distal end 55 of the first connector housing 54 of the first connector 52 in abutting relationship.

Alternatively, the first connector 52 and the second connector 72 may be assembled before assembly of the retainer clip body 102 thereto. Once the first connector 52 and the second connector 72 are assembled, the retainer clip body 102 may be installed and assembled thereto by first inserting the wires 48 of the wire harness 44 into the wire harness passage 130 between deformable retaining arm 110 and support base 160.

Thereafter, retainer clip body 102 may be slid in an engagement direction along the wires 48 of the wire harness 44, and the guide rails 166 of the retainer clip body 102 may be inserted into guide channel 42 of mounting base 20 of motor vehicle lamp 10, such that the bottom of the guide rails 166 make contact with the bottom of the guide channel 42, in which case the first connector 52 and the second connector are now aligned in connection plane 182.

The retainer clip body 102 subassembly may then be slid in an engagement direction such that the first engagement element 112 makes contact with the second connector housing 74 of the second connector 72, causing the deformable retaining arm 110 to pivot about pivot regions 150 of the retainer clip body 102, resulting in the leading portion 122 of the deformable retaining arm 110 to pivot upwards and the first engagement element 112 to slide along the top of the second connector housing 74 and subsequently the first connector housing 54 while the trailing portion 120 of the deformable retaining arm 110 pivots downwards.

Simultaneously, the second connector housing 74 enters the second connector receptacle 140. Thereafter, as the first engagement element 112 extends past the top of the first connector housing 54, the elastic memory in the pivot regions 150 of the retainer clip body 102 forces the deformable retaining arm 110 to pivot such that the leading portion 122 of the deformable retaining arm 110 pivots downwards and the first engagement element 112 engages with the distal end 55 of the first connector housing 54 of the first connector 52 in abutting relationship.

With regards to disassembly, the retainer clip body 102 may be disassembled from the first connector 52 and the second connector 54 by first depressing the trailing portion 120 of the deformable retaining arm 110, causing the deformable retaining arm 110 to pivot about pivot regions 150 of the retainer clip body 102, resulting in the leading portion 122 of the deformable retaining arm 110 to pivot upwards and first engagement element 112 to disengage from first connector housing 54 of first connector 52. Thereafter, the retainer clip body 102 may be slid in a disengagement direction away from the first connector 52 and the second connector 72. Moreover, the wires 48 of the wire harness 44 may be removed from wire harness passage 130 such that the retainer clip may be completely removed from the wire harness 44 without disconnecting the first connector 52 and the second connector 72.

While a preferred embodiment of the present disclosure has been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the present disclosure. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present disclosure is/are used.

Those skilled in the art will recognize, or be able to ascertain using no more than routine experimentation, many equivalents to the specific embodiments of the disclosure described herein. It is, therefore, to be understood that the foregoing embodiments are presented by way of example only and that, within the scope of the appended claims and equivalents thereto, the disclosure may be practiced otherwise than as specifically described and claimed. The present disclosure is directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms. The indefinite articles "a" and "an," as used herein in the specification and in the claims, unless clearly indicated to the contrary, are understood to mean "at least one." The phrase "and/or," as used herein in the specification and in the claims, should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified, unless clearly indicated to the contrary.

An abstract is submitted herewith. It is pointed out that this abstract is being provided to comply with the rule requiring an abstract that will allow examiners and other searchers to quickly ascertain the general subject matter of the technical disclosure. It is submitted with the understanding that it will not be used to interpret or limit the scope or meaning of the claims, as set forth in the rules of the U.S. Patent and Trademark Office.

The following non-limiting reference numerals are used in the specification.

10 lamp
14 lens
16 lens housing
20 mounting base
30 lamp light source
40 printed circuit board
42 guide channel
44 wire harness
48 wires
50 connection apparatus
52 first connector
54 first connector housing
55 distal end
56 plug receptacle
58 window opening
72 second connector
74 second connector housing
75 proximal end
76 plug
78 deformable tab
100 retainer clip
102 retainer clip body
104 longitudinal axis
110 deformable retaining arm
112 first engagement element
113 first connector engagement plane
114 arm inner face/surface
116 mid-region
120 trailing portion
122 leading portion
124 recess
130 wire harness passage
140 second connector receptacle
142 second engagement element
143 second connector engagement plane
144 end wall
150 pivot region
160 support base
162 platform
164 support base inner face/surface
166 guide rail
170 aperture
180 operation plane
182 connection plane
184 separation plane

What is claimed is:

1. A retainer clip (100) to secure an electrical connection of a first connector (52) of a motor vehicle lamp (10) and a second connector (72) of a wire harness (44) configured to mate with each other to establish the electrical connection, the retainer clip (100) comprising:

a retainer clip body (102) comprising a deformable retaining arm (110) configured to inhibit separation of the first connector (52) and the second connector (72) upon assembly thereof with the first connector (52) and the second connector (72);

a second connector receptacle (140) defined by the retainer clip body (102), the second connector receptacle (140) configured to receive the second connector (72) therein; and a support base (160) configured to cooperate with the motor vehicle lamp (10) to align the second connector (72) with the first connector (52) in a connection plane (182) to assemble the second connector (72) and the first connector (52).

2. The retainer clip (100) of claim 1 wherein:

the retainer clip body (102) further comprises a first engagement element (112) and a second engagement element (142), the first engagement element (112) configured to engage with the first connector (52) and the second engagement element (142) configured to engage with the second connector (72).

3. The retainer clip (100) of claim 2, wherein:

the first connector (52) and the second connector (72) are separable in a separation plane (184);

the first engagement element (112) is configured to engage the first connector (52) in a first connector engagement plane (113) substantially transverse to the separation plane (184); and the second engagement element (142) is configured to engage the second connector (72) in a second connector engagement plane (143) substantially transverse to the separation plane (184).

4. The retainer clip (100) of claim 2, wherein:

the first engagement element (112) comprises a leading engagement element of the retainer clip body (102) configured to engage with a distal end (55) of the first connector (52); and the second engagement element (142) comprises a trailing engagement element of the retainer clip body (102) configured to engage with a proximal end (75) of the second connector (72).

5. The retainer clip (100) of claim 2 wherein:

the first engagement element (112) is disposed on the deformable retaining arm (110); and the deformable retaining arm (110) is pivotable to engage the first engagement element (112) with the first connector (52) and disengage the first engagement element (112) from the first connector (52).

6. The retainer clip (100) of claim 2, wherein:

the first engagement element (112) is provided by a snap-fit hook located on the deformable retaining arm (110).

7. The retainer clip (100) of claim 2, wherein:

the second engagement element (142) is provided by a wall (144) of the retainer clip body (102) which provides an end wall of the second connector receptacle (140).

8. The retainer clip (100) of claim 2, wherein:

the deformable retaining arm (110) and the support base (160) are spaced from one another by a wire harness passage (130) located between the deformable retaining arm (110) and the support base (160);

the wire harness passage (130) is configured such that the second connector (72) is inhibited from passing completely through the wire harness passage (130); and the second engagement element (142) narrows the wire harness passage (130) to inhibit the second connector (72) of the wire harness (44) from passing completely through the wire harness passage (130) while allowing wires (48) of the wire harness (44) to completely pass through the wire harness passage (130).

9. The retainer clip (100) of claim 1 wherein:

the deformable retaining arm (110) and the support base (160) are joined by at least two laterally spaced pivot regions (150) of the retainer clip body (102) which are arranged substantially transverse to a longitudinal length of the deformable retaining arm (110).

10. The retainer clip (100) of claim 9 wherein:

the second connector receptacle (140) is located between and partially defined by the at least two laterally spaced pivot regions (150) of the retainer clip body (102).

11. The retainer clip (100) of claim 10 wherein:

the deformable retaining arm (110) overlies the support base (160); and the at least two laterally spaced pivot regions (150) space the deformable retaining arm (110) and the support base (160) from each other such that a wire harness passage (130) is established between the deformable retaining arm (110) and the support base (160); and the second connector receptacle (140) forms a portion of the wire harness passage (130) between the deformable retaining arm (110) and the support base (160).

12. The retainer clip (100) of claim 11 wherein:

a portion of the wire harness passage (130) is narrowed such that the second connector (72) is inhibited from passing completely through the wire harness passage (130).

13. The retainer clip (100) of claim 11 wherein:

the retainer clip body (102) further comprises at least one aperture (170) which extends along an overall length of the wire harness passage (130) such that the wire harness passage (130) is not fully enclosed along the overall length of the wire harness passage (130).

14. The retainer clip (100) of claim 1 wherein:

the retainer clip body (102) is configured to be assembled with the first and second connectors (52, 72) or dissembled from the first and second connectors (52, 72) when the first connector (52) and the second connector (72) are connected without disconnecting the first and second connectors (52, 72) from each other.

15. The retainer clip (100) of claim 1 in combination with the motor vehicle lamp (10) wherein:

the first connector (52) and the second connector (72) are connectable in a connection plane (184);

the support base (160) comprises at least one guide rail (166);

the motor vehicle lamp (10) comprises at least one guide channel (42); and the support base (160) is configured to cooperate with the motor vehicle lamp (10) to align the second connector (72) with the first connector (52) in the connection plane (184) to assemble the second connector (72) and the first connector (52) by arranging the at least one guide rail (166) of the support base (160) in the guide channel (42) of the motor vehicle lamp (10).

16. The retainer clip (100) and the motor vehicle lamp (10) combination of claim 15 wherein:

the motor vehicle lamp (10) comprises a mounting base (20); and the at least one guide channel (42) of the motor vehicle lamp (10) is formed in the mounting base (20).

17. The retainer clip (100) and the motor vehicle lamp (10) combination of claim 15 wherein:

the support base (160) comprises at least two guide rails (166); and the support base (160) is configured to cooperate with the motor vehicle lamp (10) to align the second connector (72) with the first connector (52) in the connection plane (184) to assemble the second connector (72) and the first connector (52) by arranging the at least two guide rails (166) of the support base (160) in the guide channel (42) of the motor vehicle lamp (10).

* * * * *